United States Patent [19]

Stone et al.

[11] 4,018,171

[45] Apr. 19, 1977

[54] YARN TENSIONING MEANS FOR TUFTING MACHINES

[75] Inventors: William David Stone, East Ridge; Alvin Truit Bonner, Sr., Chattanooga, both of Tenn.

[73] Assignee: The Singer Company, New York, N.Y.

[22] Filed: Sept. 29, 1976

[21] Appl. No.: 727,828

[52] U.S. Cl. ..... 112/79 R; 226/90

[51] Int. Cl.[2] ..... D05C 15/18

[58] Field of Search ..... 112/79 R, 79 A, 78, 112/218 R; 226/90, 174, 176, 180, 186; 85/69

[56] References Cited

UNITED STATES PATENTS

| | | | |
|---|---|---|---|
| 3,192,820 | 7/1965 | Pitzer | 85/69 |
| 3,224,395 | 12/1965 | Card | 112/79 R |
| 3,338,198 | 8/1967 | Short et al. | 112/79 R |

FOREIGN PATENTS OR APPLICATIONS

| | | | |
|---|---|---|---|
| 46-17869 | 4/1971 | Japan | 226/90 |

*Primary Examiner*—H. Hampton Hunter
*Attorney, Agent, or Firm*—Edward L. Bell; Robert E. Smith; Alan Ruderman

[57] ABSTRACT

A tufting machine having corrugated yarn tension rolls for pulling out the slack from the yarn. The tension rolls are mounted in pairs and supported at their ends in bearing brackets. The pair of brackets at each end of the roll pair are hinged together so that one may be pivoted relative to the other. A quick release clamping member preferably having an expandable diameter pin and a cam handle connect each pair of brackets together and act to rapidly disconnect them upon turning of the handle. An adjustable screw is provided to adjust the separation between the rolls.

4 Claims, 4 Drawing Figures

Fig.3
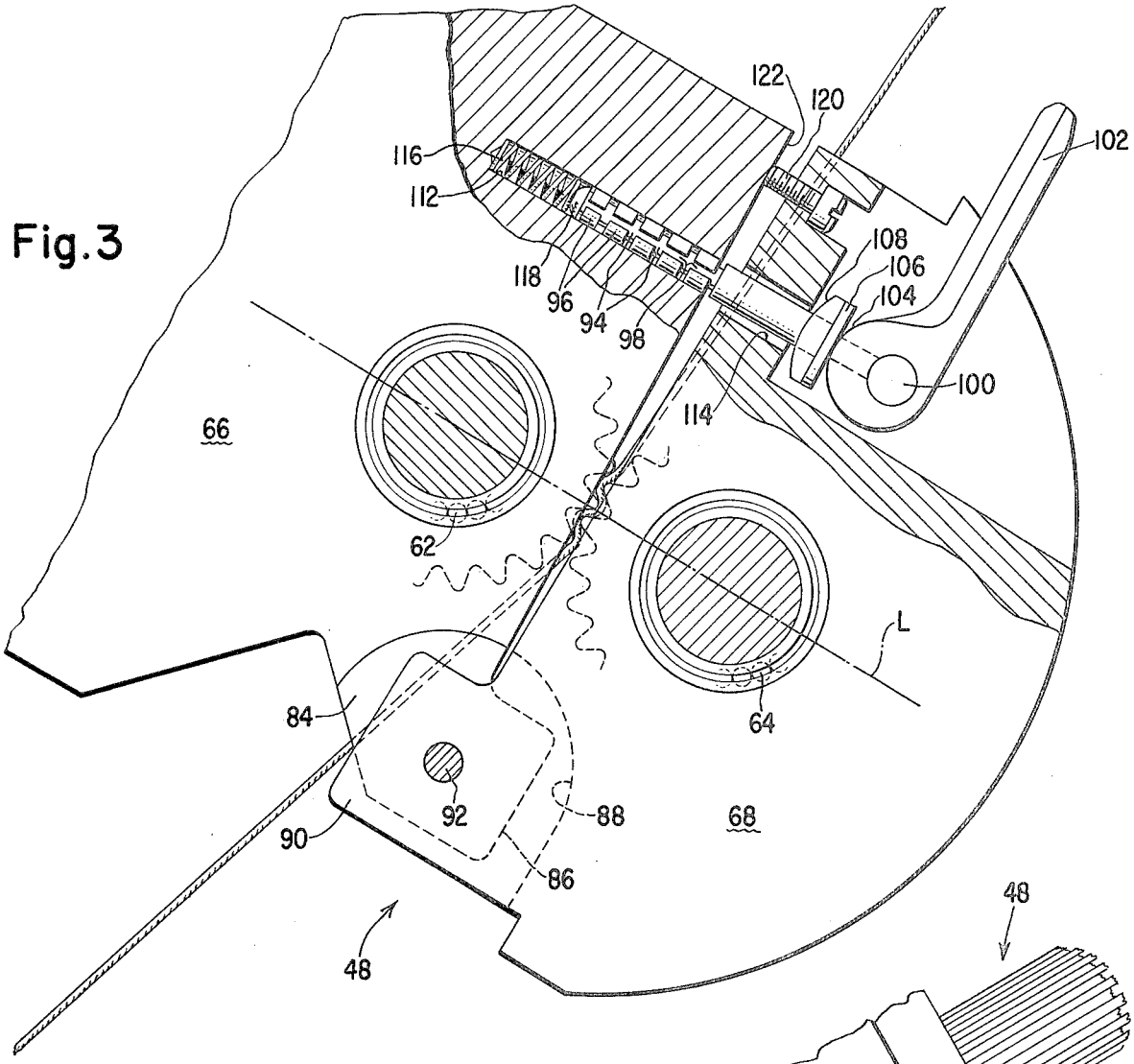
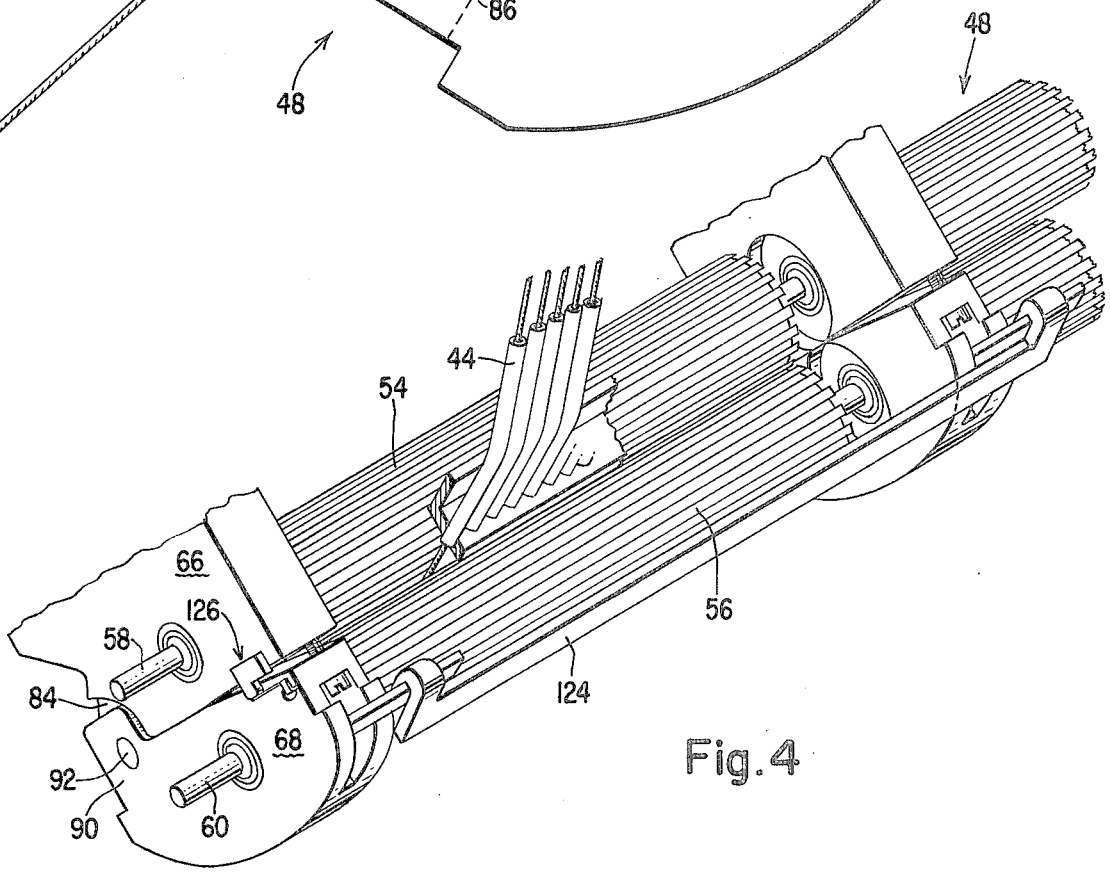
Fig.4

YARN TENSIONING MEANS FOR TUFTING MACHINES

BACKGROUND OF THE INVENTION

This invention relates to tufting machine yarn tension rolls and more particularly to the mounting of such rolls so that the rolls may be disengaged rapidly in the event of an accident and for threading the yarn between the rolls.

Yarn tension or puller rolls are corrugated rolls used extensively in tufting machines especially those having a pattern attachment of the feed roll type including a yarn guiding tube bank having tubes of unequal length for conveying the yarn from the various feed rolls to the needles. The tension or puller rolls act to supply yarn to the needles at uniform tension despite the difference in path length traveled by the yarn through the tubes.

The tension rolls are mounted in pairs and supported at their ends in bearing brackets. Each roll pair of the prior art is supported at each end in a two-piece bracket with the cooperating brackets bolted together. The center distance between the rolls are adjusted by shims placed between the two pieces of the bracket.

This arrangement presents a safety hazard if the fingers of an operator are inadvertently engaged between the corrugated rolls. A safety feature provided by the prior art comprises the use of a plastic guard about the rolls to prevent the inadvertent insertion of fingers. The guard can be pivoted for threading of the rolls and includes a micro-switch and circuitry for shutting the machine when the guard is lifted. However, it has been found that the electrical circuit and thus the safety device is overridden in practice in attempts to save time when threading the rolls. With the prior art roll bracket construction when something is caught between the rolls, the machine must be stopped to remove it and the bolts released by unscrewing. The releasing of the bolts takes time and the injury can thus be extensive.

SUMMARY OF THE INVENTION

In order to overcome this hazardous condition, the present invention provides each pair of tension rolls with cooperating bearing brackets with each pair of brackets being secured together by means of a hinge and a quick release clamping member. The hinge is spaced on one side of a line passing through the center of the rolls and the quick release clamp is spaced on the other side of the line so that when the clamp is released the brackets pivot relative to each other to open the nip between the rolls. The quick-release clamp is preferably of the type having an expandable diameter pin controlled by a camming handle. The nip between the rolls is, moreover, adjustable by means of a screw for setting the separation angle between the brackets.

It is therefore the primary object of the present invention to provide a yarn tension roll assembly for a tufting machine in which the nip between each pair of rolls can be rapidly opened.

BRIEF DESCRIPTION OF THE DRAWING

The particular features and advantages of the invention as well as other objects will become apparent from the following description taken in connection with the accompanying drawings, in which:

FIG. 3 is a fragmentary sectional view greatly enlarged illustrating the yarn tension roll mounting brackets of the present invention and FIG. 4 is a fragmentary perspective view of a pair of yarn tension rolls illustrating the mounting brackets at each end thereof.

DESCRIPTION OF THE PREFERRED EMBODIMENT

Figure 1:
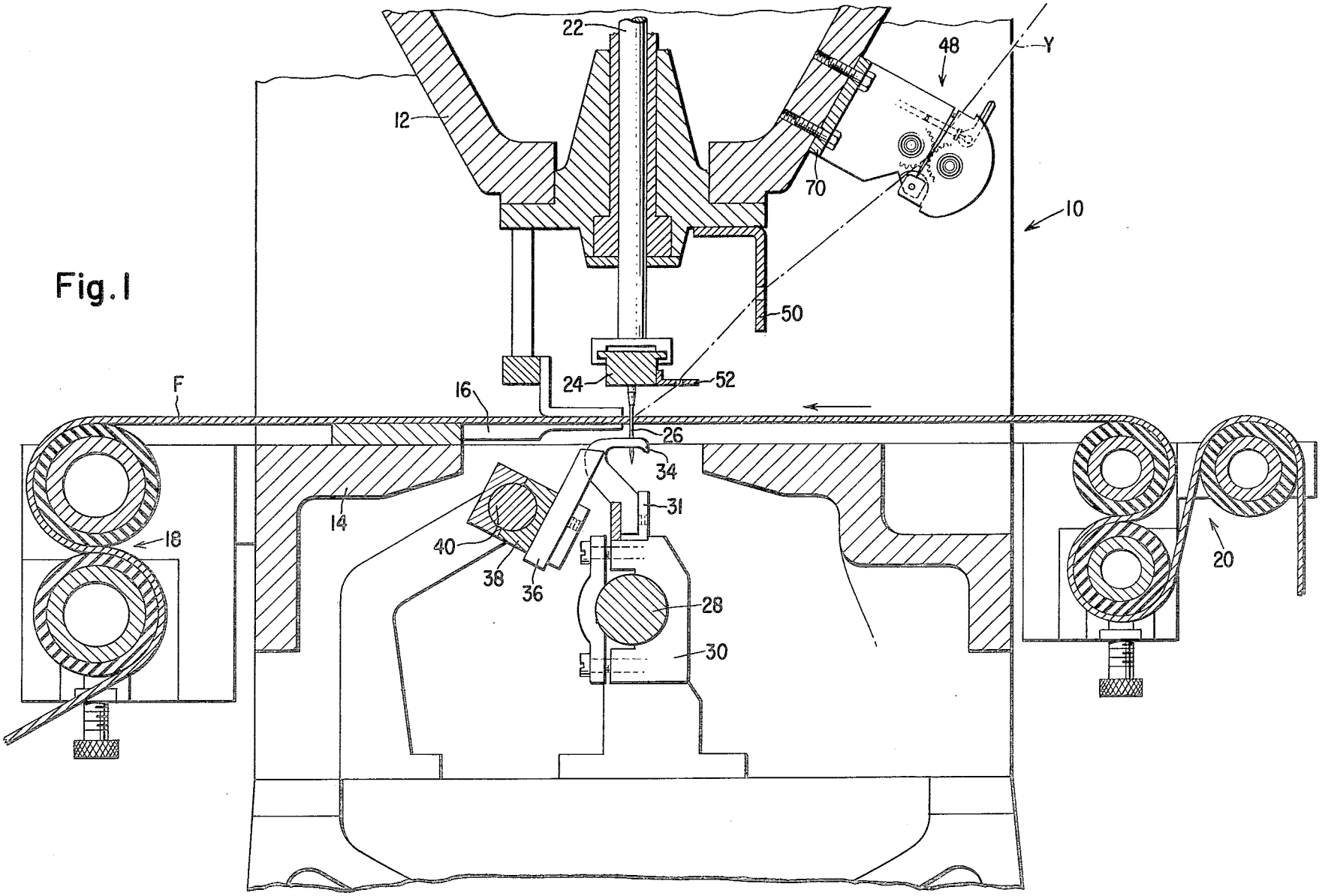
FIG. 1 is a fragmentary sectional view of a tufting machine employing yarn tension roll assemblies embodying the present invention.
Figure 2:
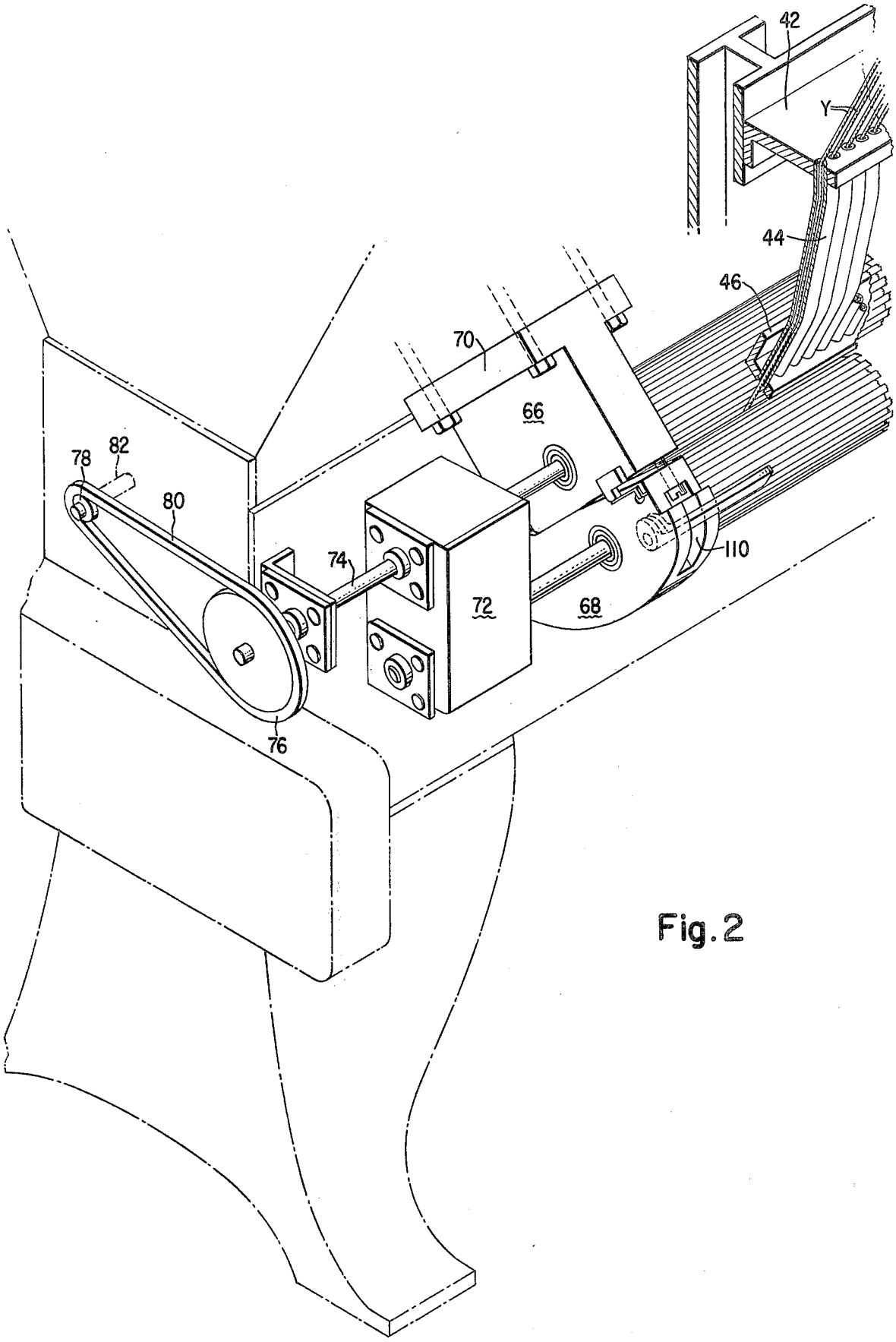
FIG. 2 is a fragmentary perspective view of the tufting machine in phantom and illustrating the yarn tension rolls of FIG. 1 and the drive therefore.

Referring now to the accompanying drawings, there is illustrated a portion of a tufting machine comprising a frame 10 including a head 12 over-hanging a bed 14. A backing fabric F in the form of a web is passed from front to rear across a bed plate 16 in the direction of the arrow A in FIG. 1 by a conventional feed mechanism including feed rolls 18 and 20. Mounted in the head for endwise reciprocation is a push rod 22 which at its lower end carries a needle rod 24 that in turn carries a plurality of needles 26. The rod 22 is adapted to be reciprocated by conventional means (not shown) such as a crank rod that cooperates with an eccentric upon a main shaft journaled longitudily of the head. In operation, the needles are, of course, threaded with yarn Y fed by conventional means such as feed roll (not shown).

Longitudinally of the bed 14 there is journaled a hook or loop shaft 28 on which is mounted a bracket 30 carrying a looper bar 32 adapted to receive a plurality of loopers 34, one for each needle for holding the loop or tuft during the upward stroke of the needles. The looper shaft 28 is oscillated in a conventional manner through means driven off the main shaft.

In order to form cut-pile, each looper has an associated knife 36 carried by a knife bar 38 mounted on a shaft 40 which is conventionally oscillated through mechanism driven off the main shaft in timed relation to the oscillation of the loopers. Each knife 36 includes a cutting edge biased by the flexibility of the knife against the side of the looper and is adapted to cooperate with the bottom edge of each loopr bill which acts as a ledger to severe the loops on the blade to form cut-pile. The loops are severed by the knives as they move back on the bill as the fabric F is fed and thus carries the loops into the area where the knife is operative.

The yarn Y is positively fed from a creel by the yarn feed rollers (not shown) through a horizontally disposed guide panel 42. From this guide panel the yarn ends are threaded through yarn guide means comprising a plurality of tubes 44 (only certain of which are illustrated) whose lower ends are collected in a longitudily disposed guide collector angle 46. For a broadloom carpet machine in which several repeat patterns are formed by the bank of needles 26, the tubes 44 are arranged in sets, there being one set for each pattern repeat. In order to supply the plurality of yarns Y delivered from the lower ends of the tubes 44 at a uniform tension to the needles 26 there is provided a yarn tension or puller roll assembly 48, hereinafter described in detail. From the roll assembly 48 the yarn passed through a fixed yarn guide 50 secured to the head 12 of a tufting machine, and then through a yarn jerker 52 secured to the needle bar, and finally is threaded through the needles.

The yarn tension or puller roll assembly 48 comprises a pair of corrugated puller rolls 54 and 56 having intermeshing teeth supported on shafts 58 and 60 respectively which rotate in bearing 62 and 64 mounted in brackets 66 and 68 at each end of the rolls. The brackets 66 includes flange means 70 for securing the brackets to the tufting machine. The rolls 54 and 56 are preferably identical in size and shape having equal number of teeth of similar and uniform shape and height. The teeth are preferably rounded, both at the root and the crest so that there are no sharp edges. The roll 54 is positively driven and due to the intermeshing teeth drives roll 56, both rotating at a peripheral speed greater than the speed of any yarn in order to pull out the slack, stretch and permit slipping of all the yarns between the teeth. The shaft 58 of roll 54 is driven through a reduction gear box 72 from a drive shaft 74 preferably driven by a pulley or similar means 76. The pulley 76 may be driven from a pulley 78 by means of a belt 80 trained about the pulleys 76 and 78. The pulley 78 is preferably mounted on the main drive shaft 82 of the tufting machine which is driven through a suitable power source (not shown).

As best illustrated in FIGS. 3 and 4, the outer surface of brackets 68 opposite to that facing the rolls includes a recessed portion 84 at a location spaced on one side of a line L passing through the centers of both rolls 54 and 56 and the shafts 58 and 60. An ear 86 is formed on the bracket 66 adjacent the recess 84 and is received within a similar recess 88 formed adjacent the outer surface of brackets 68 while an ear 90 formed on the outer surface of bracket 68 adjacent the recess 88 is received within the recess 84. Each of the ears 86 and 90 include a hole for receiving a pivot pin 92 so that the brackets 68 are pivotably supported by the respective brackets 66.

Spaced on the other side of the line L is a quick-connect, quick-disconnect means for securing the brackets 68 to the respective brackets 66 when the former are pivoted into operative position. The quick-connect, quick-disconnect means in the preferred embodiment consist of an expandable diameter pin and adjustable diameter bushing assembly of the type illustrated in U.S. Pat. Nos. 3,009,747 and 3,192,820. The assembly comprises an inner pin 94 positioned within a male and female bushing stack having a plurality of split bushing female members 96 and male bushing members 98 which are in turn located within the female members 96. The exterior of the male members may be convexed and the interior of the female members concaved. The outer end of the pin 94 is secured to a barrel nut 100 mounted eccentrically in a bifucated handle member 102. The handle 102 includes bifucated cam surfaces 104 at its periphery spaced from the barrel nut. Positioned adjacent the surfaces 104 is a thrust washer 106 abutting a half male bushing 108 having a spherical surface facing oppositely to the washer.

The expandable diameter pin and bushing assembly is positioned between a slot formed in the bracket 68 and is located within a bore 112 in the bracket 66 and a bore 114 in bracket 68. A release spring 116 may be positioned within the bore 112 to act against a stop 118 formed on the pin 94. The assembly is positioned within the bores 114 and 112 and when the cam handle is actuated by rotation counter-clockwise as viewed in FIG. 3 an axial compressive force is created against the bushing assembly to force the female bushings out against the bore 112 of the bracket 66 and at the same time force the male bushings against the inner pin 94. This provides a tight radial fit in bore 112 and draws the bracket 66 and 68 together about pivot pin 92 as the cam surfaces 104 act against the washers 106 and bushing 108. To release the brackets 66 and 68 from each other, and thereby the rolls 54 and 56, the handle is rotated clockwise as viewed in FIG. 3. A simple turn of the handle rapidly releases the puller rolls if an operator's hand is caught to prevent excessive injury.

To set adjust the separation between the rolls 54 and 56 a screw 120 is threaded through the bracket 68 and bears against the adjacent facing surface 122 of bracket 66. The nip between the rolls is controlled by setting the separation angle between the two brackets at the pivot pin.

As an additional feature, the handles 102 at each end of a roll pair may be interconnected by an arm 124 so that by turning the handle at one end the brackets at both ends of the roll pair will rapidly separate. Moreover, a microswitch 126 may be carried by each bracket pair so that when each of the brackets 68 is pivoted away from the respective brackets 66 the tufting machine is cut-off from the power supply. This will further prevent inadvertent injury between the rolls when threading the yarn there between.

Numerous alterations of the structure herein disclosed will suggest themselves for those skilled in the art. However, it is to be understood that the present disclosure relates to a preferred embodiment of the invention which is for purposes of illustration only and not to be construed as a limitation of the invention. All such modifications which do not depart from the sirit of the invention are intended to be included within the scope of the appended claims.

Having thus set forth the nature of the invention, what we heretofore claim is:

1. In a muliple-needle tufting machine having a multiplicity of yarns fed from guide means to a like member of needles, a pair of rolls between which said yarns pass from said guide means to said needles, means for driving said rolls at a peripheral speed greater than the speed at which said yarns are fed to said rolls, and mounting means for supporting said rolls, said mounting means comprising a first bracket member at each end of a first roll of said pair of rolls and a second bracket member at each end of the second roll of said pair of rolls, means mounting said first bracket members on said tufting machine, means pivotably supporting each second bracket member from a respective first bracket member at a location spaced from one side of a line passing through the centers of said first and second rolls, and quick-connect, quick-disconnect means located on the other side of said line for securing said second bracket members to the first bracket members to lock said second roll in operative position and for releasing said second bracket members from said first bracket members to separate said rolls rapidly.

2. In a tufting machine as recited in claim 1 wherein said quick-connect, quick-disconnect means comprises a first bore in each first bracket member, a second bore in each second bracket member, said second bore opening externally of said bracket member, said first and second bores of cooperating bracket members being in substantial alignment when said rolls are in operative position, radially expandable bushing means including a central pin positioned in said first and second bores, said pin having an end extending out the second bore, a handle having a cam surface for acting against said second bracket, means pivotally connecting said end of said pin eccentrically to said handle whereby activation of said handle forces the bushing means to expand and grip the wall of said first bore.

3. In a tufting machine as recited in claim 2 wherein the handle at one end of the pair of rolls is interconnected to the handle at the other end of the pair of rolls for releasing the respective second bracket members simultaneously.

4. In a tufting machine as recited in claim 1 including an adjustment screw threadedly received in said second bracket members and abutting said first bracket members to adjust the separation angle between the brackets and thereby the separation between said rolls.

* * * * *